US005197153A

United States Patent [19]

Hara

[11] Patent Number: 5,197,153

[45] Date of Patent: Mar. 30, 1993

[54] BUBBLE GENERATING DEVICE FOR BATHTUBS

[76] Inventor: Zenzaburo Hara, 31-1 Kamiyamacho, Shibuya-ku, 150, Tokyo, Japan

[21] Appl. No.: 639,906

[22] Filed: Jan. 10, 1991

[30] Foreign Application Priority Data

Jan. 12, 1990 [JP] Japan ..... 2-5862
Jan. 12, 1990 [JP] Japan ..... 2-5863
Feb. 8, 1990 [JP] Japan ..... 2-30047

[51] Int. Cl.[5] ..... A61H 33/02
[52] U.S. Cl. ..... 4/541.4
[58] Field of Search ..... 4/542-544, 4/541.4

[56] References Cited

U.S. PATENT DOCUMENTS 3,806,964 4/1974 Vanegas et al. ..... 4/542
4,924,535 5/1990 Yamasaki ..... 4/544
4,957,101 9/1990 Hara ..... 4/542 X
4,984,313 1/1991 Hara ..... 4/542

*Primary Examiner*—Charles E. Phillips

[57] ABSTRACT

An air bubble generating device for use in a bathtub has a casing with an electric pump operative to take in and pressurize water from the bathtub, an air inlet operative to take in air from a region above the water in the bathtub, and a nozzle operative to jet a mixture of air taken in by the air inlet and water taken in and pressurized by the electric pump. The casing is provided with means for gripping by hand and a plurality of suction cups on a rear side opposite the nozzle for attaching the casing to the inner wall surface of the bathtub. A power source unit for driving the electric pump is separate from the casing, and may convert power from a commercial power source to a DC current or house a DC secondary battery. The power source may be provided with an idling prevention circuit for suspending output current when the pump is in an idle state, and a rush current reducing circuit for reducing rush current when the electric pump is actuated.

4 Claims, 12 Drawing Sheets

BUBBLE GENERATING DEVICE FOR BATHTUBS

BACKGROUND OF THE INVENTION

1. Field of the Invention

This invention relates to an air bubble generating device for producing an air bubble whirlpool in a relatively small sized bathtub. The device is designed for household use and for health promotion purposes.

This invention relates, more particularly, to an air bubble generating device to be placed in a bathtub and which comprises an electric pump for sucking hot water from the tub, a nozzle to mix the air with the water from the pump and a casing which integrally houses the pump and the nozzle. The device is characterized in that said casing can be held by hand by a user and fixed on the inner wall surface of the tub by suction cups, and the pump is powered by converted electricity. The device is small enough to be used in a small sized tub or a narrow bathroom comfortably.

2. History of the Prior Art

There have been known various bubble bath systems for household use which are placed within a tub to generate air bubbles in the water so that the whirlpool bubbles are directed at a desired location of the user's body. Such prior art devices are so adapted that a casing is stably installed within a bathtub in a manner to direct the jet stream of bubbles toward a desired location of a user's body. Various handle means have been proposed for placing the device in or out of a bathtub, as some bathers do not like to use the device. As the power source for the electric motor of the pump, a secondary battery is used or commercial electric voltage is transduced to a lower level by a transducer. When using a secondary battery, the power source system may be placed on the bathroom floor.

Such prior art devices are well received when they are installed in a tub in a bathroom of a relatively large area. However, when the device is to be placed within a small bathroom, the device is too large for comfort, and poses problems for use by people living in compact apartments with small sized bathrooms. When the secondary battery is used as the power source which is placed on the bathroom floor with a length of cord extending from the casing to the battery, the device stands in the way of bathers.

BRIEF SUMMARY OF THE INVENTION

This invention resolves such problems encountered in the prior art, and provides a bubble generating device which has a light, handy and transportable casing and does not require a secondary battery. In instances where a secondary battery is used, the electrical cord is reeled in so that the device may be freely used within a small bathtub or within a small bathroom. Even when the device with the casing is placed on the bathroom floor, it does not stand in the way of the bather.

The device of the invention comprises an electric motor which sucks hot water from the bathtub and pressurizes it, an air inlet which lets in the air above the hot water, a nozzle which mixes the output water from said pump with the air let in from said air inlet and injects a jetstream of the air and water into the water in the bathtub, and a casing which houses said pump, said air inlet and said nozzle. The device is characterized in that the casing is provided with a handle which can be held by hand, and at least two suction cups on the rear surface of the side on which the nozzle is attached for fixing the device on the inner wall of the bathtub.

The power source of the electric pump, which is provided separately from the casing, receives electricity from a commercial power source and converts it into direct current. The power source preferably contains a DC secondary battery inside. Also, the power source may include an idling prevention circuit which either suspends or attenuates output current when the electric pump is idled, and a circuit to reduce rush current when the electric pump is actuated. When a DC secondary battery is used as the power source, the power source is connected with the case by an electrical cord and provided with a reel which easily winds the cord. The power source is also equipped with a receiver which houses the casing integrally, and includes a handle by which the device can be carried together with the casing.

The air inlet is a rubber pipe projecting upward from the casing, and the pipe is freely detachable from the casing.

Inasmuch as the casing which houses the pump and other elements has a handle, the device can be held by the user as he or she bathes. The device can be stably fixed on the wall surface in the bathtub with suction cups provided on the rear side opposing the attachment of the nozzle so that the jet stream containing air bubbles from the nozzle may be directed toward any desired location on the bather's body.

Because the power source for the electric pump is separately installed outside the bathroom, it does not stand in the bather's way, even if it is used in a narrow bathroom. The power source device installed outside the bathroom includes an idling prevention circuit and a rush current reducing circuit The idling prevention circuit prevents the pump from damaging the device when it idles after the casing is pulled from the water in the bathtub. The rush current reducing circuit prevents a rush of excessive electric current to the motor when the pump is actuated so that a user holding the casing of the device is not shocked. As almost all such electric circuits including protector circuits are mounted in the power source, the weight of the casing may be further reduced.

Where the power source for the electric motor in the pump has an internal DC secondary battery, a reel is provided for simple winding up of the electric cord which connects the casing with the power source device. The casing is not in the user's way when it is placed on the floor. The power source device can integrally house the casing and be carried by holding its handle. With the DC secondary battery internally housed in the power source device, the device may be placed within the bathroom and the door of the bathroom may be closed.

With the air inlet in the form of a self-standing type pipe, it is not easily broken, even if it contacts other articles during transportation. The pipe is freely detachable and therefor can be packaged easily and compactly.

BRIEF DESCRIPTION OF THE DRAWINGS

The foregoing and other objects, features and advantages of the invention will be apparent from the following more particular description of the preferred embodiments of the invention, as illustrated in the accompanying drawings, in which.

DETAILED DESCRIPTION

Figure 1:
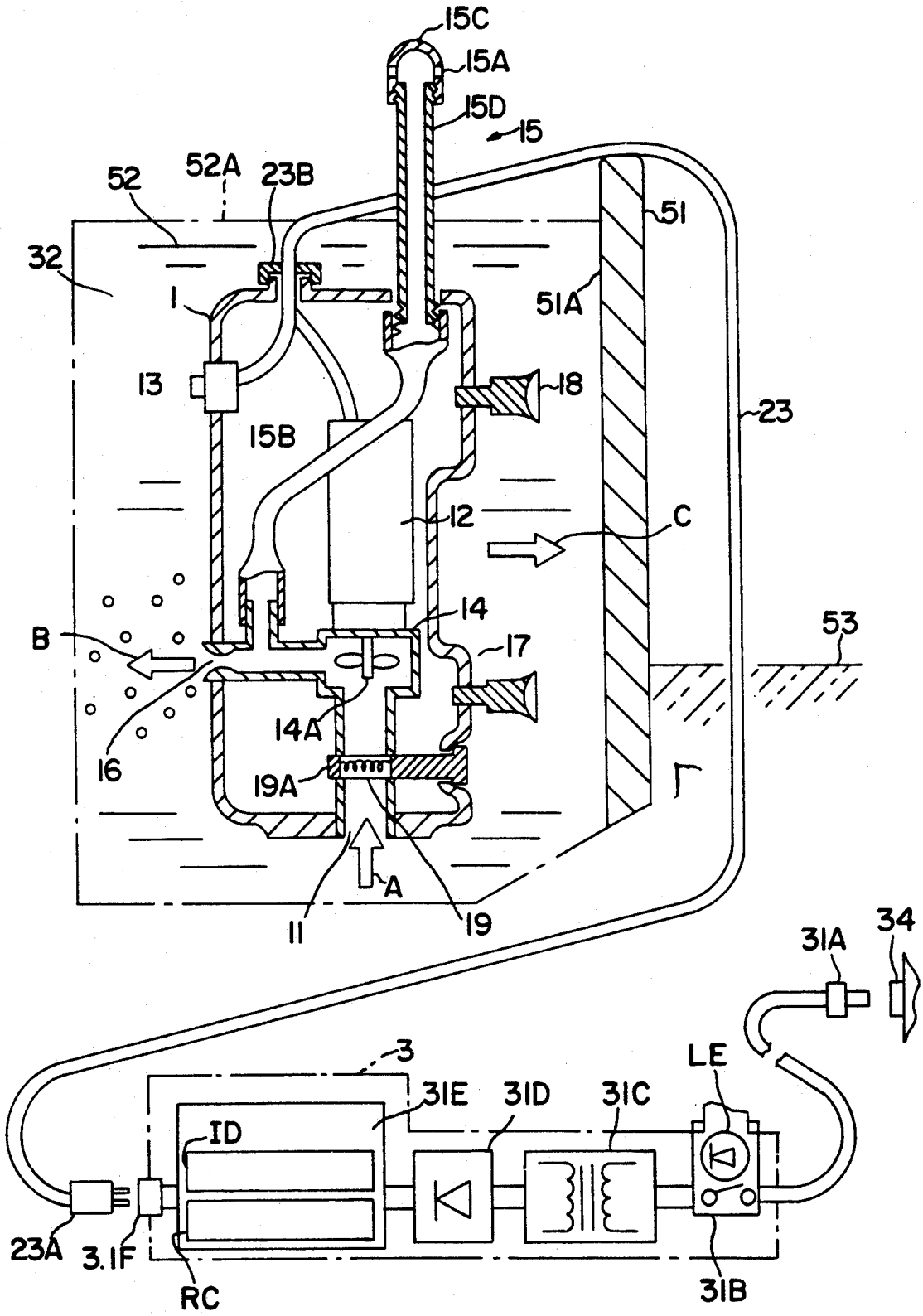
FIG. 1 is a schematic view of a first embodiment of the invention.

FIG. 1 shows schematically a first embodiment of a device according to the invention wherein a pump 14 is actuated and driven by an electric motor to suck in hot water from a bathtub 51 through a water inlet 11 in the direction shown by an arrow A and to pressurize the water. An air inlet 15 has an opening 15A which lets in air from above the water surface 52A. A nozzle 16 jets a mixture of the output water from the pump 14 and the air taken in through the air inlet 15 via an air hose 15B in a jetstream into the hot water in the bathtub in a direction shown by an arrow B. Such components are mounted in a casing 1. A filter casing 19A having an internal filter 19 is provided in a passage for the water between the water inlet 11 and the pump 14 of the casing 1.

The device of the invention is characterized in that the casing 1 is provided with a recessed portion 17 forming a finger rest for holding the device by hand and with three suction cups 18 (two of which are shown in FIG. 1) which are attached on the rear surface of the nozzle 16 and which are attached by suction to an inner wall face 51A of the bathtub 51. The power source for said electric motor 12 is an AC/DC converter 3 which is separate from the casing 1 and which receives commercial power from a plug socket 34 for household use via a receptacle 31A and produces 12 V DC. The AC/DC converter 3 is adapted for installation outside the bathroom, is connected to said casing 1 with an electrical cord 23, and is provided with a maintenance means comprising an idling prevention circuit ID and a rush current reducing circuit RC.

The AC/DC converter 3 is provided with a source switch 31B including a light emitting device LE, a transformer 31C, a rectifier circuit 31D, a controller 31E including said idling prevention circuit ID and the rush current reducing circuit RC, and a plug socket 31F. When the switch 13 is pushed, the electrical cord 23 which is connected to the plug socket 31F via a plug 23A provides 12 V DC to the motor 12 of the case 1 to actuate the pump 14.

When using the device in a bathtub, if the water inlet 11 of the casing 1 is raised above the water surface 52A, such as when the casing which has been mounted on the inner wall 51A by the suction cups 18 is removed by hand, there is no water present around a runner 14A of the pump 14. This places the pump 14 in an idling state which could possibly damage the device. To prevent such damage, this device according to the invention is adapted to suspend the supply of the DC 12 V to the motor 12.

When a user pushes the switch 113 to actuate the motor 12 while holding the casing 1 in the water by hand, the rush current in the motor 12 causes the casing 1 to vibrate violently. If there is no water around the runner 14A, the vibrations are even more violent and can cause the user to drop the casing. In order to prevent such trouble, the rush current reducing circuit RC restricts the supply of electric current to the motor 12 for a prescribed duration of time.

Figure 2:
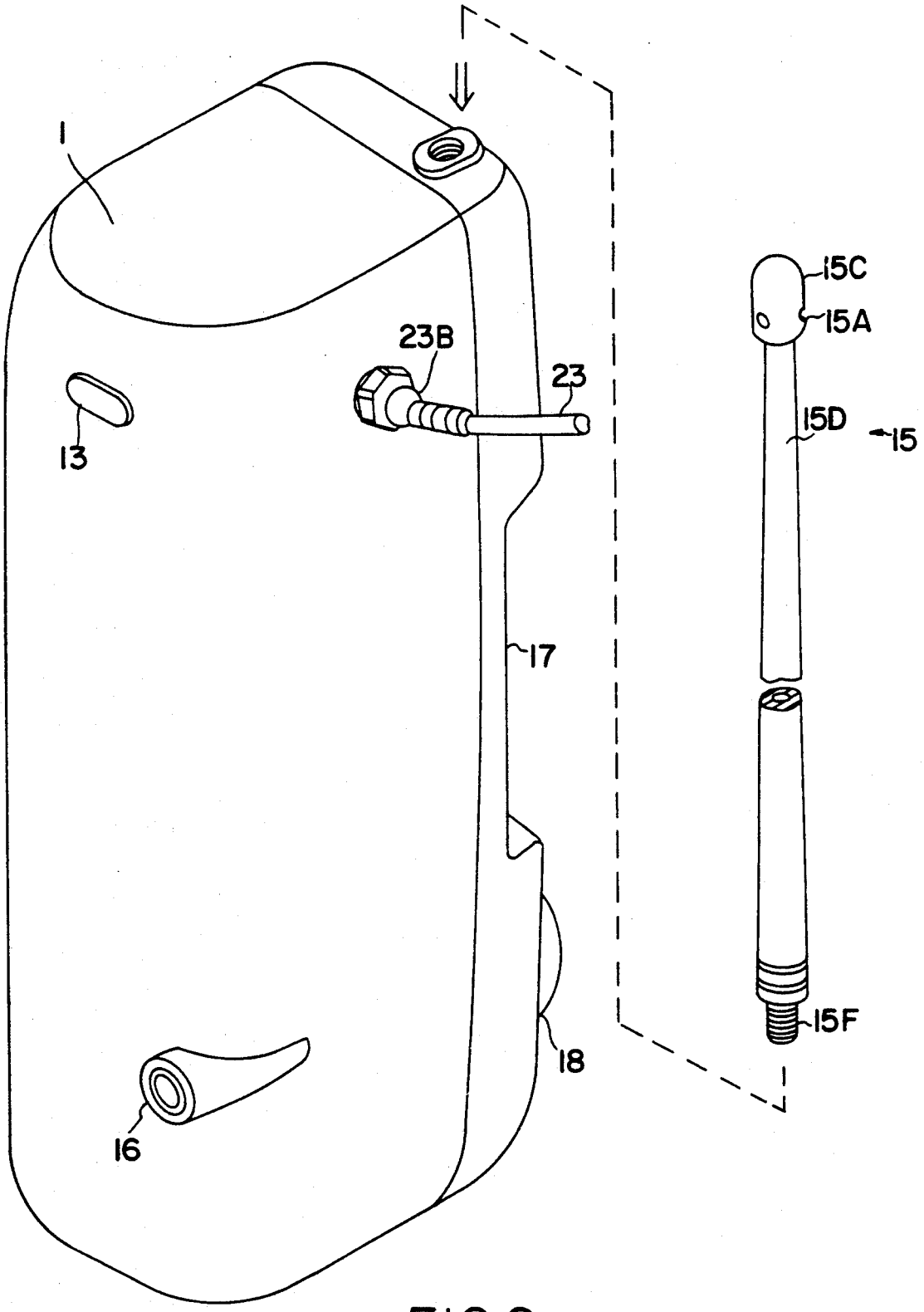
FIG. 2 is a perspective view of a casing of the embodiment of FIG. 1.

FIG. 2 shows the device with the air inlet 15 removed from the casing 1. The casing 1 has the switch 13, which is of waterproof construction, for actuating the motor inside the nozzle 16. The casing 1 also has the recessed portion 17 for finger grasping, and the electrical cord 23 for connecting the casing 1 with an AC/DC converter (not shown).

The air inlet 15 includes a cap 15C with an opening 15A and a self-supporting plastic pipe 15D which projects upwardly above the case 1. The self-supporting construction of the plastic pipe 15D is such that the pipe 15D assumes the original erect state after an external force is removed therefrom, even if the pipe 15D is deformed by lateral pressure. The pipe 15D is made of polypropylene and has enough elasticity to retain the erect state after deformation. Because of its elasticity, the pipe 15D is less susceptible to damage, even if it contacts other articles during transportation. The pipe 15D may be detached from the casing 1 by a screw 15F provided at the lower part thereof to facilitate packaging of the device as well as replacement of the air inlet 15 if it is broken.

Figure 3:
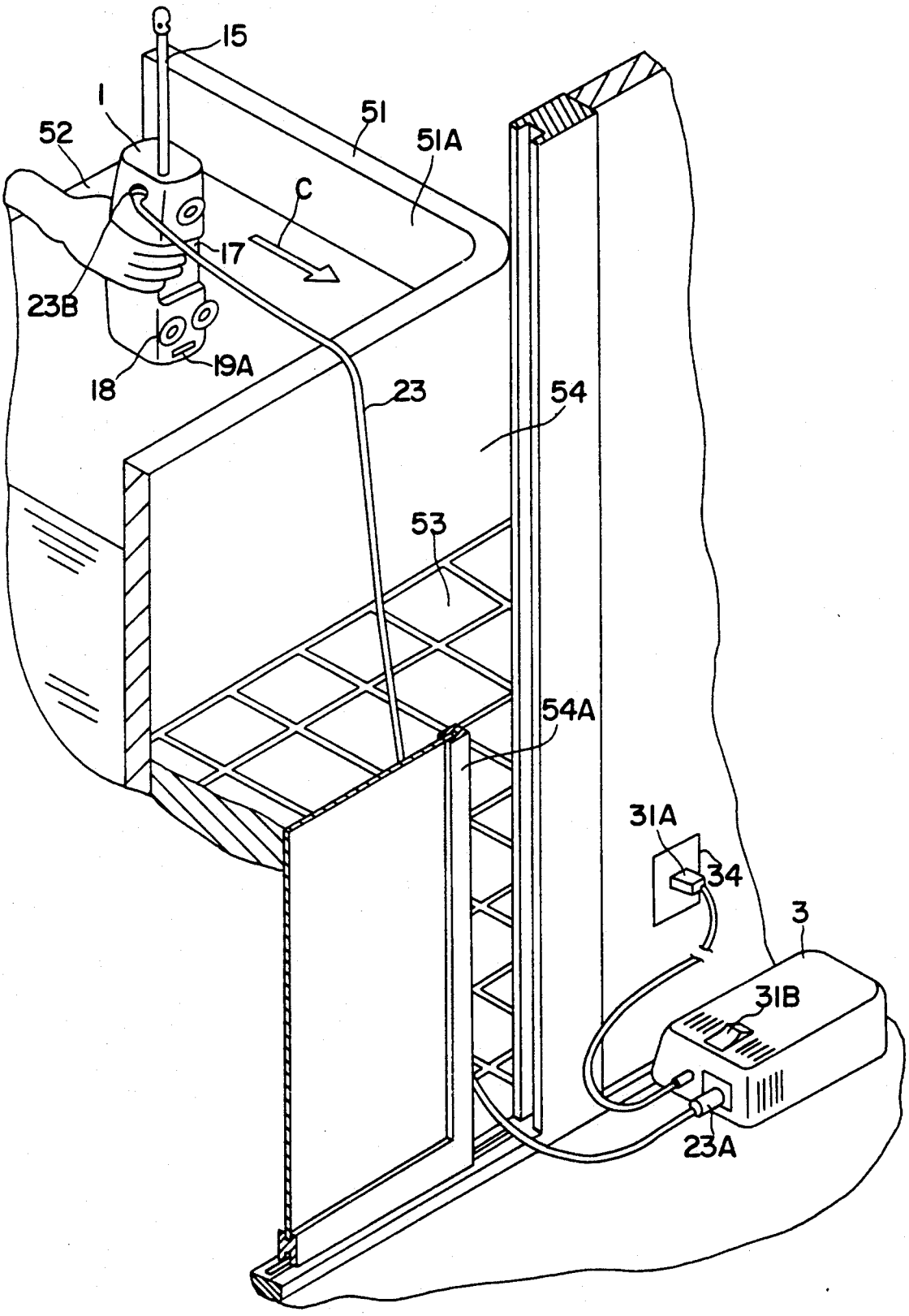
FIG. 3 is a perspective view of the embodiment of FIG. 1 as installed in a bathroom.

FIG. 3 shows the casing 1 and AC/DC converter 3 arranged inside and outside of a bathroom 54. In FIG. 3, the casing 1 is viewed from the side opposite the nozzle, but the nozzle and the water sucking port are not shown. The casing 1 has the recessed portion 17 for gripping by hand the three suction cups 18, and is connected to the electrical cord 23 via a bushing 23B. The height of the casing 1 is about 25 cm, and the width thereof is about 10 cm maximum. The weight of the device excluding the cord 23 is about 2 kg, and the device can be held by hand with the fingers resting in the recessed portion 17, and can be attached on the inner wall surface 15A of the bathtub 51 when moved in the direction shown by an arrow C. The casing 1 of this shape can be held adequately on the wall 51A of the bathtub within the water 52 by only two suction cups. But in this embodiment, three suction cups are provided for stabilization. The reference number 19A denotes a filter case which houses a sponge filter 19. The filter casing 19A can be easily pulled out to clean the filter 19 when it is clogged with fur and scale.

As shown in FIG. 3, since the AC/DC converter 3 is installed outside the door 54A of the bathroom 14, the door should be left open slightly to allow the electrical cord 23 to pass therethrough. The cord 23 extends across the floor 53 of the bathroom, but does not get in the way of bathers.

Figure 4:
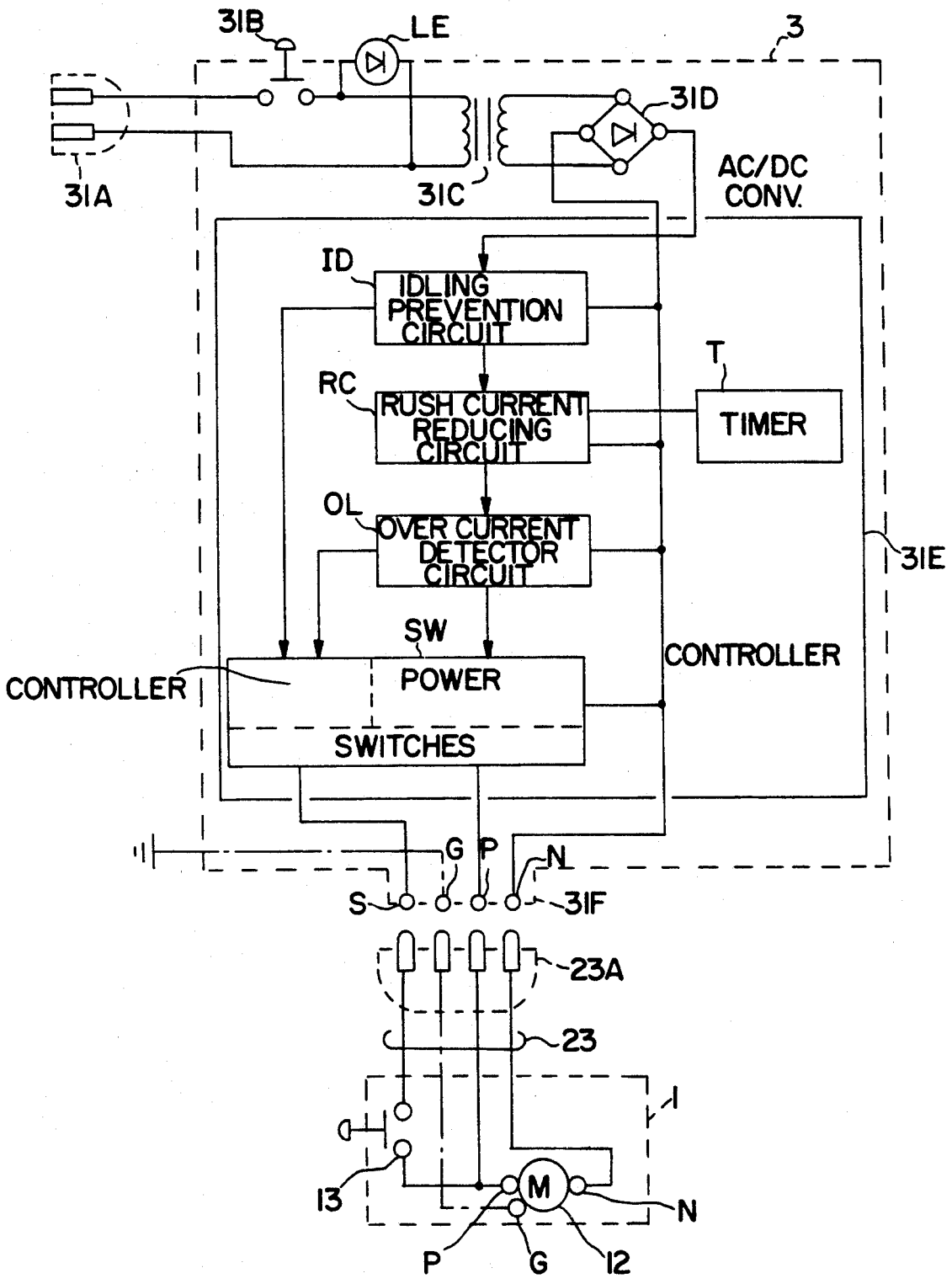
FIG. 4 is a block diagram of the electrical circuit of the embodiment of FIG. 1.

FIG. 4 shows the structure of the electrical circuit of the embodiment of FIG. 1. The idling prevention circuit ID of the controller 31E shuts out the driving current for the motor 12 by means of a switch circuit SW in order to prevent idling of the motor 12 when the motor is being driven as the water does not enter the pump of the casing 1. When the user places the device again in the water to resume operation, the motor 12 may be actuated again by pressing the switch 13. The rush current reducing circuit RC is adopted to mitigate the rush current of the motor 12 which otherwise occurs when the casing 1 is placed in the water. It restricts the level of the driving current to be supplied to the motor 12 for the initial 0.8 seconds by means of a timer T. The overcurrent detector circuit OL is a known circuit.

According to this invention, the idling prevention circuit ID is adapted to suspend the supply of DC current to the motor 12, but it may attenuate or restrict the DC current.

Figure 5:
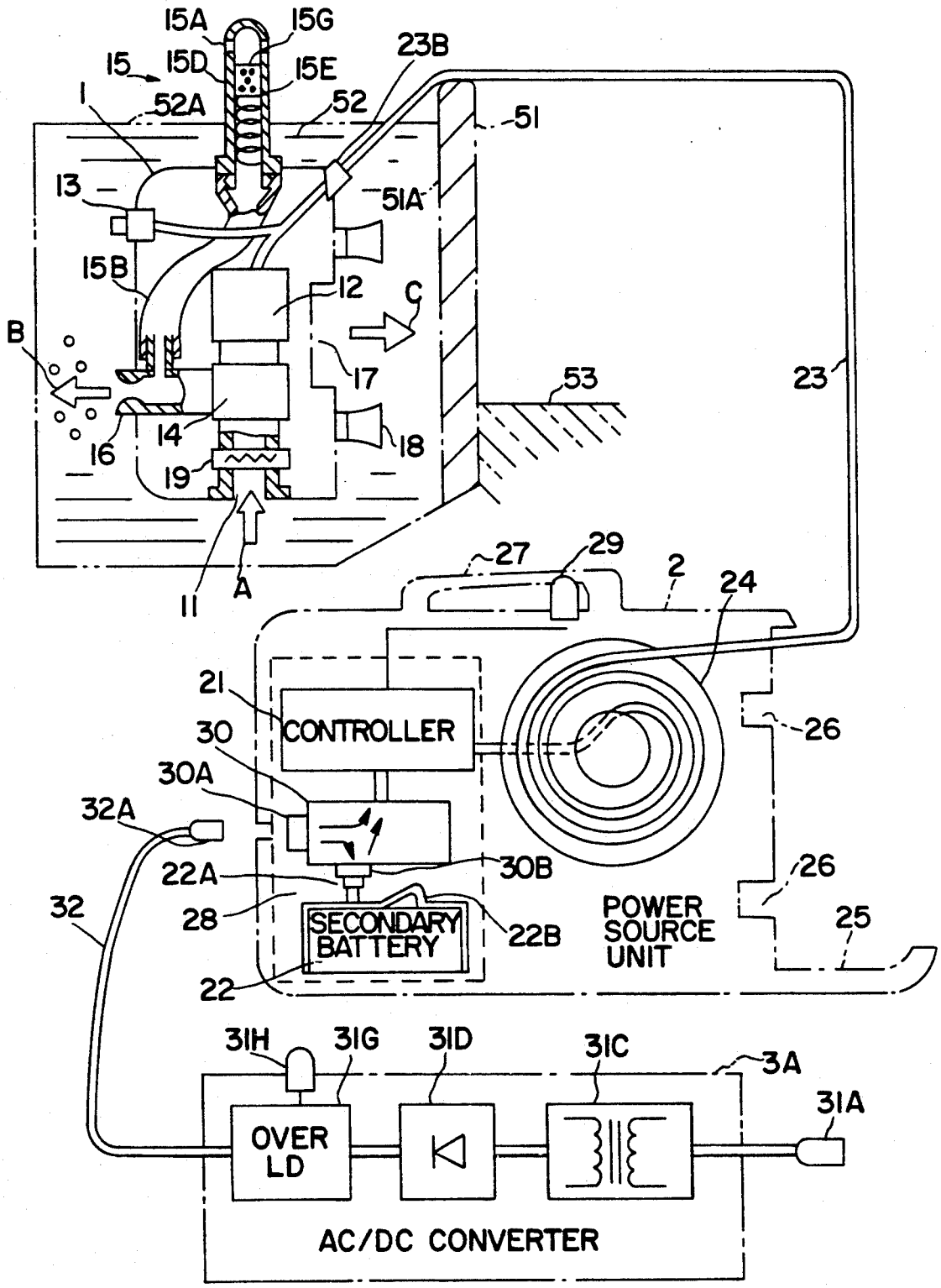
FIG. 5 is a schematic view of a second embodiment of the invention.

FIG. 5 shows a second embodiment of structure in accordance with the invention. In the embodiment of FIG. 5, the pump 14 is actuated and driven by the motor 12 to suck the water 52 from the inside of the bathtub 51 as shown by the arrow A. The motor 12 is driven by a DC electric current from a secondary battery 22 which generates DC current via a controller 21 including electrical circuits.

The second embodiment of this invention is characterized in that the casing 1 is provided with a recessed portion 17 for gripping with the fingers and three suction cups 18 (only two of which are shown). The power source unit 2 for driving the electric pump 12 is provided separately from the casing 1, is connected to the casing 1 with the electrical cord 23, and is provided with the reel 24 which can easily wind the cord 23. The power source unit 2 is provided with a recess member 25 which receives the bottom of the casing 1, recesses 26 for housing the suction cups 18 for integrally housing the casing 1, and a handle 27 so that the power source 2 together with the casing 1 can be carried by hand.

The power source unit 2 integrally houses in an interior space 28 thereof the secondary battery 22 and the controller 21 mounting electric circuits which have waterproof structure so that the unit 2 may be used inside a bathroom. The battery has a handle 22B for ease of transporting. An AC/DC converter 3A is provided separately to charge the power source unit 2.

A light emitting device 29 and a circuit which causes the device 29 to flicker when the terminal voltage at the secondary battery 22 drops are provided within the controller 21 at a position from which they are visible to the user.

The casing 1 is further provided with the switch 13 for turning on and off the power source of the motor 12 which drives the pump 14. An automatic electric switch 30 is provided within the interior space 28 of the unit 2 for substantially suspending the charge in the secondary batter 22 and supplying said DC current or the output from the AC/DC converter 3A to the motor 12 to drive the pump 14. This occurs when the switch 13 is closed during the time the battery 22 is being charged with DC current converted by the AC/DC converter 3A.

Figure 7:
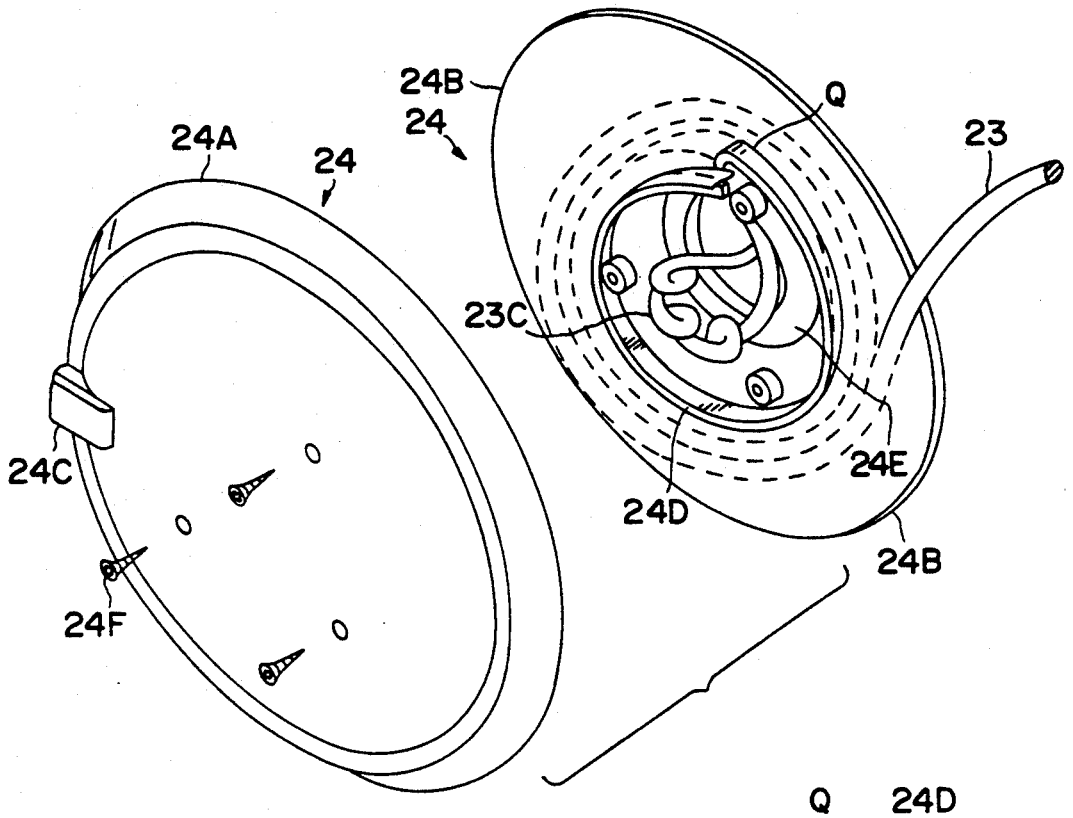
FIG. 7 is an exploded perspective view of a reel of the embodiment of FIG. 5.
Figure 8:
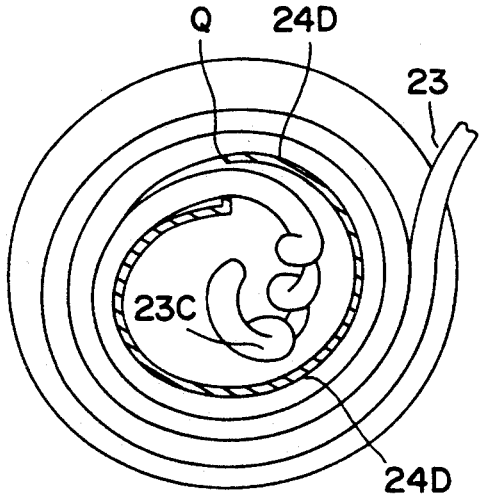
FIG. 8 is a cross-sectional view of the reel of FIG. 7.

As shown in FIG. 7 and FIG. 8, a step Q is provided on a drum 24D of the reel in order to pass the electrical cord 23 and facilitate reeling in and out of the cord 23. A knot 23C in the electrical cord 23 inside the drum 24D prevents the cord 23 from becoming twisted during winding.

Figure 10:
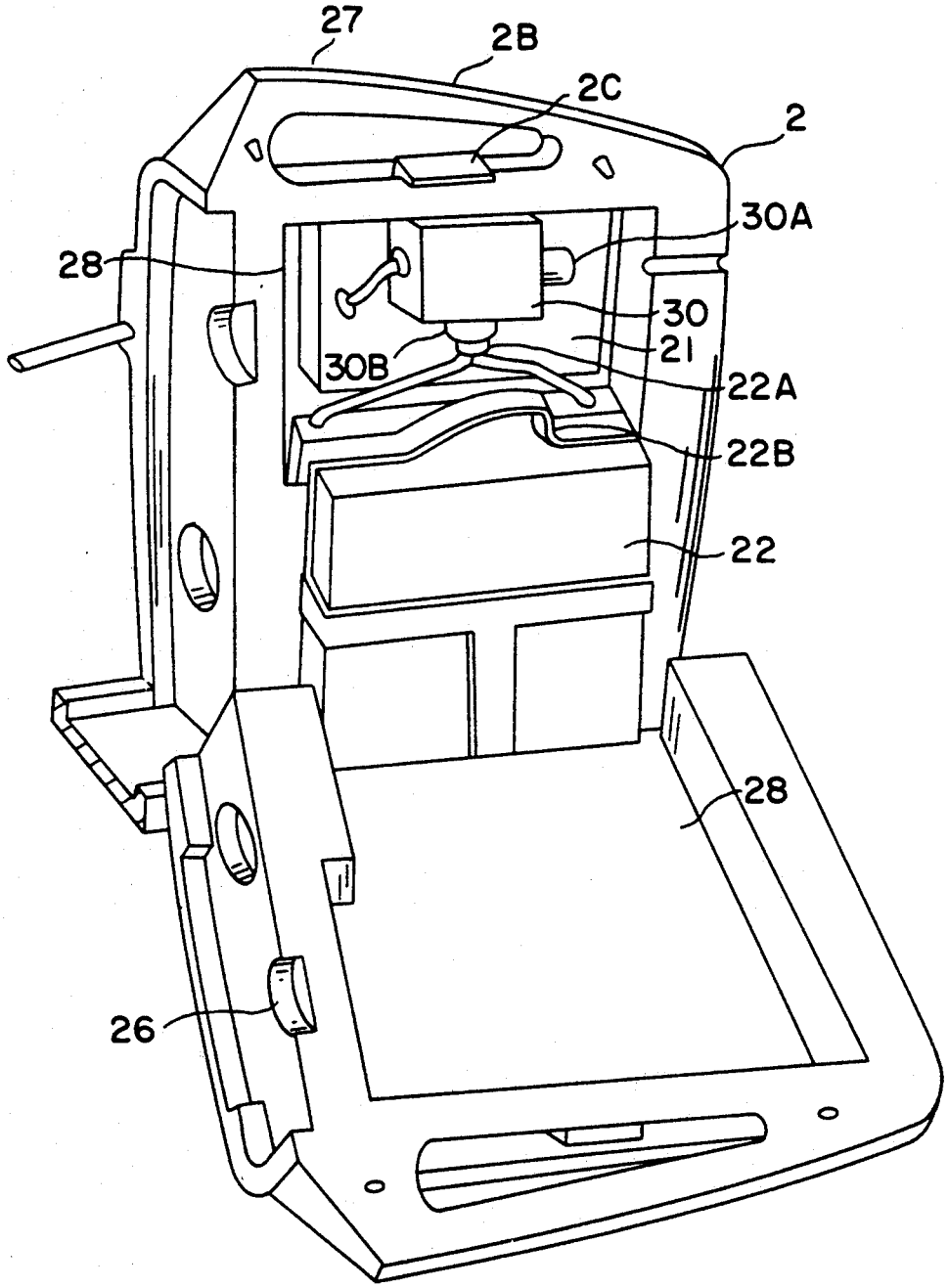
FIG. 10 is an exploded perspective view of the power source device of the embodiment of FIG. 5.

The AC/DC converter 3A which is shown by dotted line in FIG. 5 includes a receptacle 31A, a transducer 31C, a rectifier 31D, an overcharge prevention circuit 31G and a light emitting device 31H. The AC/DC converter 3A is installed outside a bathroom. An electrical cord 32 extends to the outside of the converter 3A. As shown in FIG. 10, the side wall of the unit 2 is temporarily opened, the electrical cord 32 is connected to a waterproof jack 30 A of the automatic switch 30, and then the unit is assembled again.

The automatic power source switch 30 is charged by sending the DC output from the rectifier 31D to the secondary battery 22. If during such charging, a user carries the casing 1 into a bathroom and closes the switch 13 to activate the motor 12, the switch 30 sends the DC current to the motor 12 via the controller 21 and suspends the supply of current to the battery 22. This allows use of the casing in a bathtub, even during charging. Therefore, the size of the battery can be made small in order to decrease the weight of the power source unit. (See FIG. 10).

Figure 6:
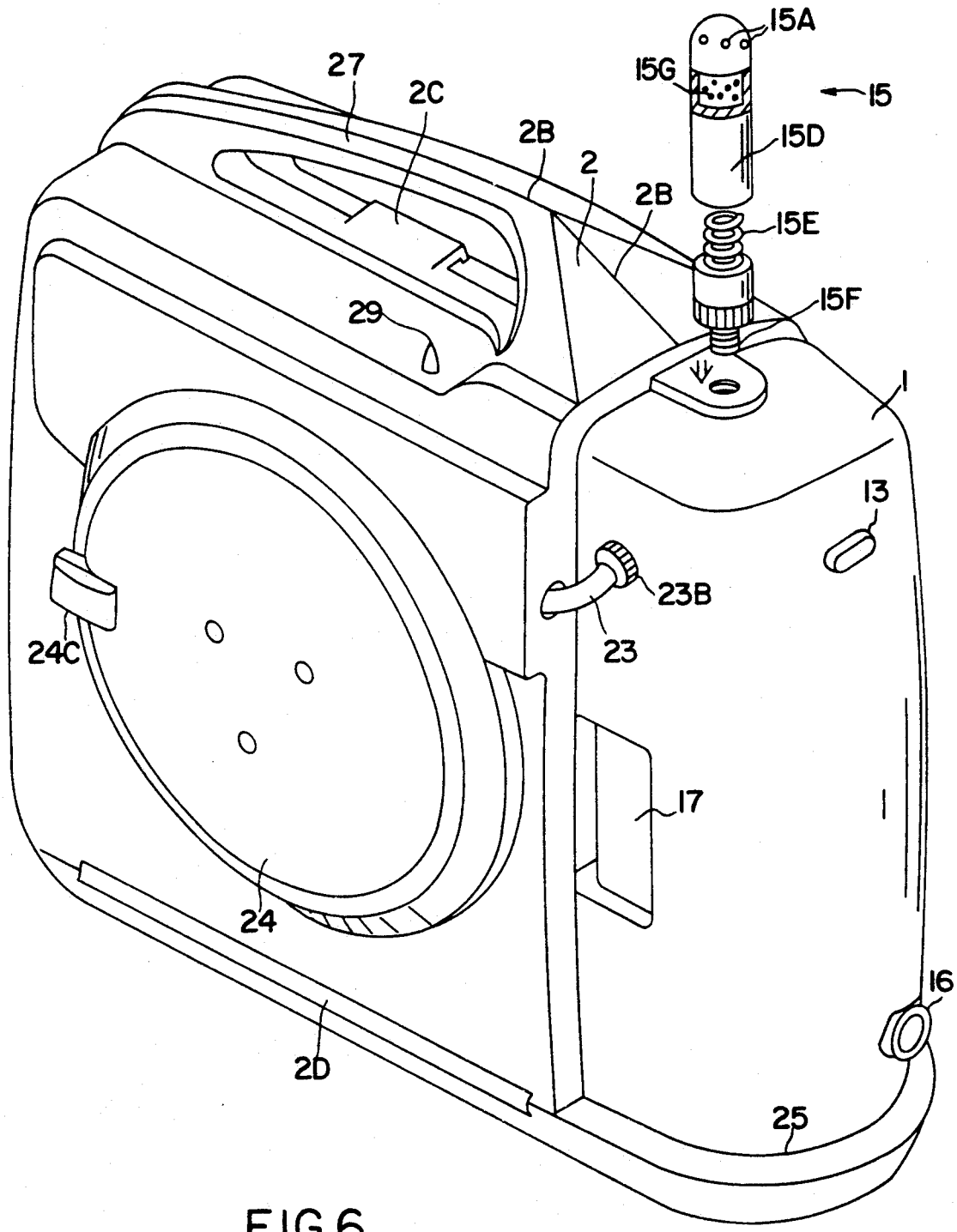
FIG. 6 is a perspective view of a casing of the embodiment of FIG. 5 as housed within a power source device.

FIG. 6 shows the casing 1 when it is housed within the receiver of the power source unit 2. The casing 1 is provided with the switch 13 of waterproof construction for actuating the internal motor, the air inlet 15 comprising the opening 15A for air intake, the self-supporting rubber pipe 15D, the nozzle 16 and the recessed portion 17 for gripping. The casing 1 is connected to the power source unit 2 by the electrical cord 23 via the bushing 23B.

The air inlet 15 is securely self-supported with the rubber pipe 15D extending upwardly, and with a metal coil spring 15E therein. The rubber pipe 15D is provided with a sponge muffler 15G near the opening 15A at the tip end of the inlet 15. The muffler 15G is provided to prevent noises from being produced by the inflow of the air into the narrow inlet passage. Such noise is not intensive, but can be unpleasant.

The power source unit 2 may be easily transported by holding the handle 27 on the upper part thereof, when the casing 1 is fitted on the bottom thereof with the recess member 25 of the unit 2. The unit 2 has on one side thereof the reel 24 for winding the cord 23 by the handle 24D. The electrical cord 23 is wound up to facilitate carrying the unit 2. When the unit 2 is placed on the floor, it does not get in the way of bathers as it does not occupy a large area.

As shown in FIG. 7, the reel 24 includes an outer reel 24A having a handle 24C, and an inner reel 24B. FIG. 8 is a cross-sectional view thereof. A separate drum 24D on which the cord 23 is wound is provided on each of the outer and inner reels 24A and 24B (as shown in part by the broken line in FIG. 7), and the inner reel 24B is attached in a freely rotatable manner to a shaft 24E which is mounted with bolts and nuts on the inner wall of the power source unit 9 (not shown). A step is provided on the drum 24D as shown by the point Q in FIG. 7, and the cord 23 extends through the drum 24D at the position Q as shown by the broken line. Since the cord 23 is fed out from the inside of the reel when being wound by means of the handle 24C, the cord 23 is first wound thereon for one winding and is then wound upon the first winding. Due to the step provided on the drum 24D, the cord may be smoothly taken in or out from the reel. Therefore, a user can easily handle the unit, even with wet hands. As shown in FIG. 7, the cord 23 is provided with the knot 23C in advance in the opposite direction against the rotational direction of the reel, and is then connected to the controller 21 (see FIG. 5) through said inner wall. Therefore handling of the reel does not twist the cord 23.

Figure 9:
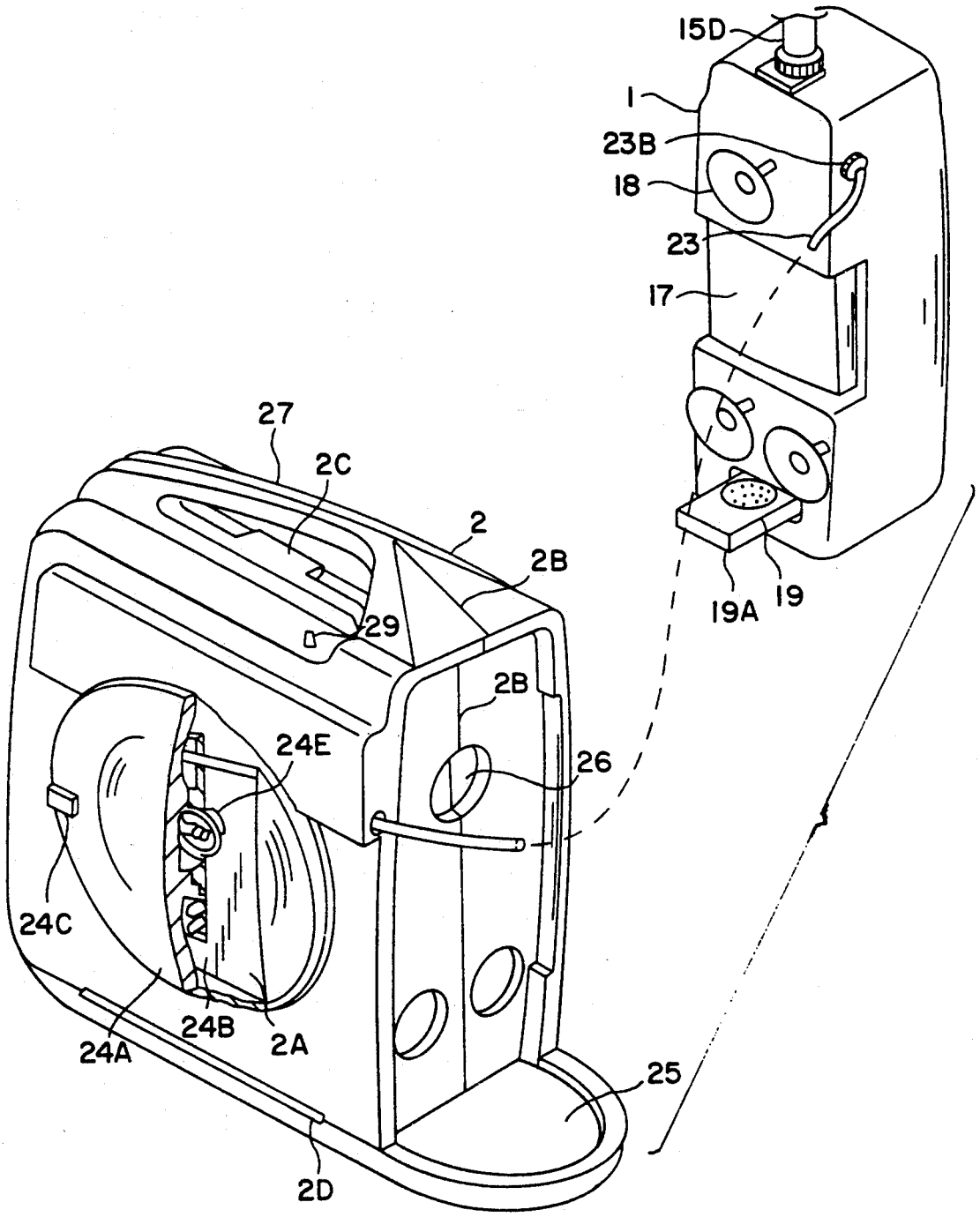
FIG. 9 is a perspective view of the embodiment of FIG. 5 showing the casing as it is separated from the power source device.

FIG. 9 shows the casing 1 separated from the power source unit 2. In FIG. 9, the casing 1 is viewed from the side of the housing on the unit 2, but the nozzle and the water inlet are not shown. The casing 1 is provided with the recessed portion 17 by which a user grips the case, three suction cups 18 and the electrical cord 23 connected by the bushing 23B. The height of the casing 1 is about 25 cm, and the width is about 10 cm maximum. The weight of the device excluding the cord 23 is about 2 kg; light enough to be carried by holding it at the recessed portion 17. The casing 1 having this shape is securely retained on the inner wall of the bathtub with only two suction cups in the water. However, this embodiment is provided with three suction cups 18 for further stability. The reference numeral 19 denotes the sponge filter which is contained in the filter casing 19A. Inasmuch as the casing 19A is easily pulled out, the filter 19 can be cleaned without difficulty when it is clogged with fur and scale.

The recess member 25 of the unit 2 is a receiver which fits with the bottom of the casing 1, and the recesses 26 form containers to house the suction cups 18 when the casing 1 is received. By placing the casing 1 within the unit 2, the parts are assembled integrally to facilitate carrying by a handle 27. The reference numeral 2B in FIG. 9 indicates the lines at which opposite portions of the outer sheath of the unit 2 separate. The line 2B passes through the handle 27 so that the unit 2 can be separated to turn the left part thereof downward on the hinge 2D at the bottom thereof when a clamp 2C under the handle 27 is unlocked.

FIG. 10 shows the unit 2 with the side wall part and the main body separated, the side wall being on the side opposing the reel. The internal space 28 of the unit 2 houses the controller 21, the secondary battery 22, and the automatic power switch 30. The controller 21 and the switch 30 are of waterproof construction, and are secured within the space 28. When the waterproof plug 22A is separated from the waterproof jack 30B of the switch 30, the secondary battery 22 may easily be removed using the handle 22B. Because the controller 21 and the switch 30 are waterproof, it is not particularly necessary to make the space 28 watertight. Although the side wall of the unit 2 on the side of the reel is not shown as being split in FIG. 10, the wall may be split.

Figure 11:
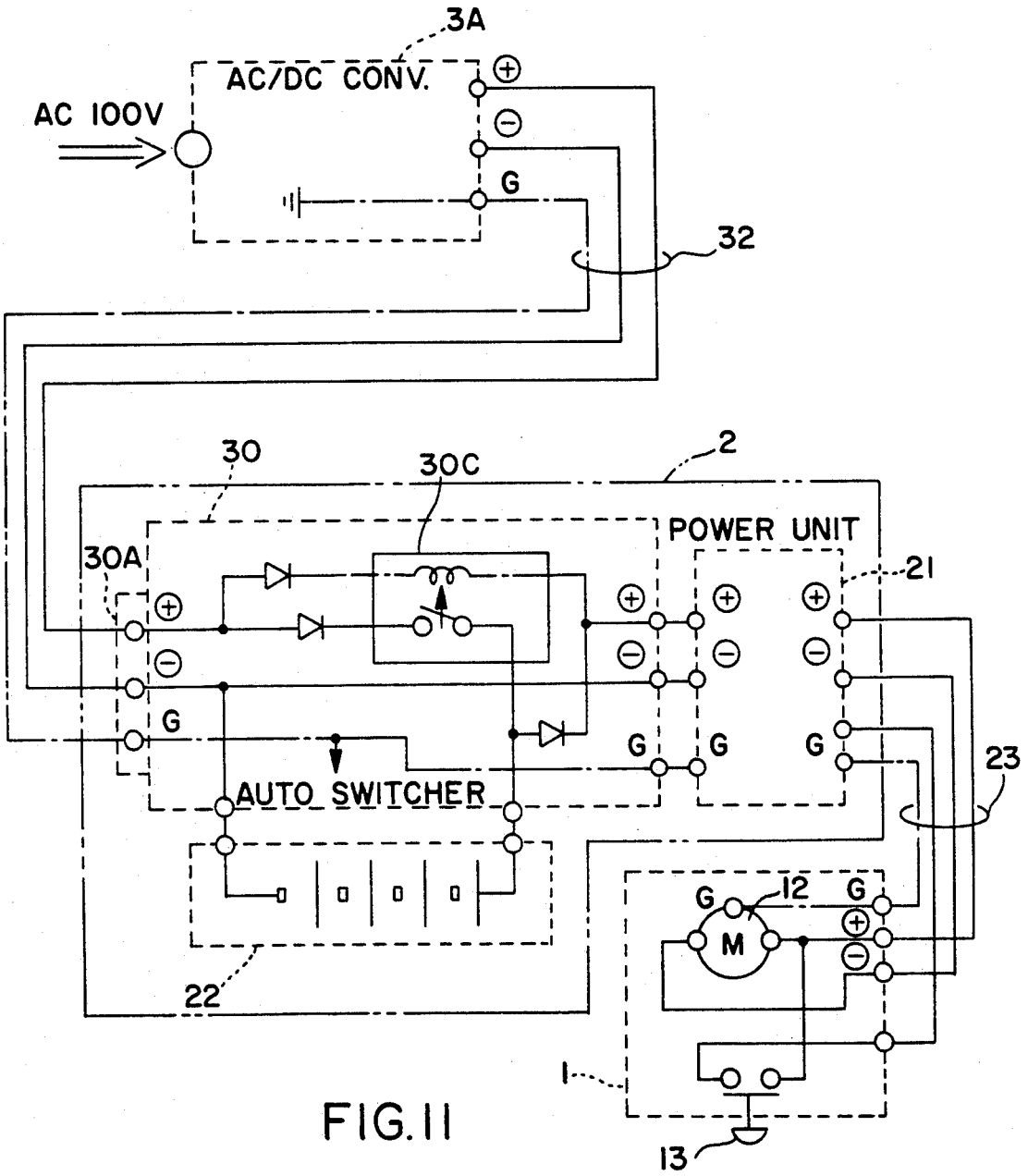
FIG. 11 is a schematic diagram of an automatic power switch of the embodiment of FIG. 5.

FIG. 11 is a circuit diagram showing the embodiment of the automatic power source switch. In FIG. 11, internal details of the AC/DC converter 3A and the controller 21 are omitted. The switch 30 includes a relay device 30C. The DC current supplied from the converter 3A via the cord 32 is branched out on the positive pole side, and the branched out circuits are connected respectively to a circuit of said relay device 30C on the operation side and to the contact side. The circuit branch connected to the circuit on the operation side is connected also to the casing 1 via the controller 21 and the cord 23, and further branches out for connection to the motor 12 and the switch 13. The circuit branch connected to the circuit on the contact side is also connected to the positive terminal of the secondary battery 22.

Accordingly, when the cord 32 is connected to the switch 30, the secondary battery 22 is charged as the DC current is applied to the positive terminal of the secondary battery on the positive side. When a user brings the casing 1 in such a state into a bathtub and closes the switch 13, the circuit of the device 30C on the operation side is energized to substantially break the circuit on the contact side. This suspends charging of the battery 22, and the motor 12 of the casing 1 is driven by DC current outputted from the converter 3A. As described above, while the cord 32 is connected to the switch 30 and the converter 3A is supplying DC current, the motor 12 does not consume the electric current of the secondary battery 22.

The actual time that a user uses the air bubble generator device is about 15 minutes, according to studies made. If the rated time of the secondary battery to be used for the motor which drives a pump is 50 minutes, the first three users can use the device with the power provided by the secondary battery while the fourth and subsequent users must connect the cord 32 as shown in FIG. 11. Such an arrangement enables the size of the secondary battery 22 to be minimized, and this reduces the size and weight of the power source unit 2 conveniently for use in a small bathroom.

Figure 12:
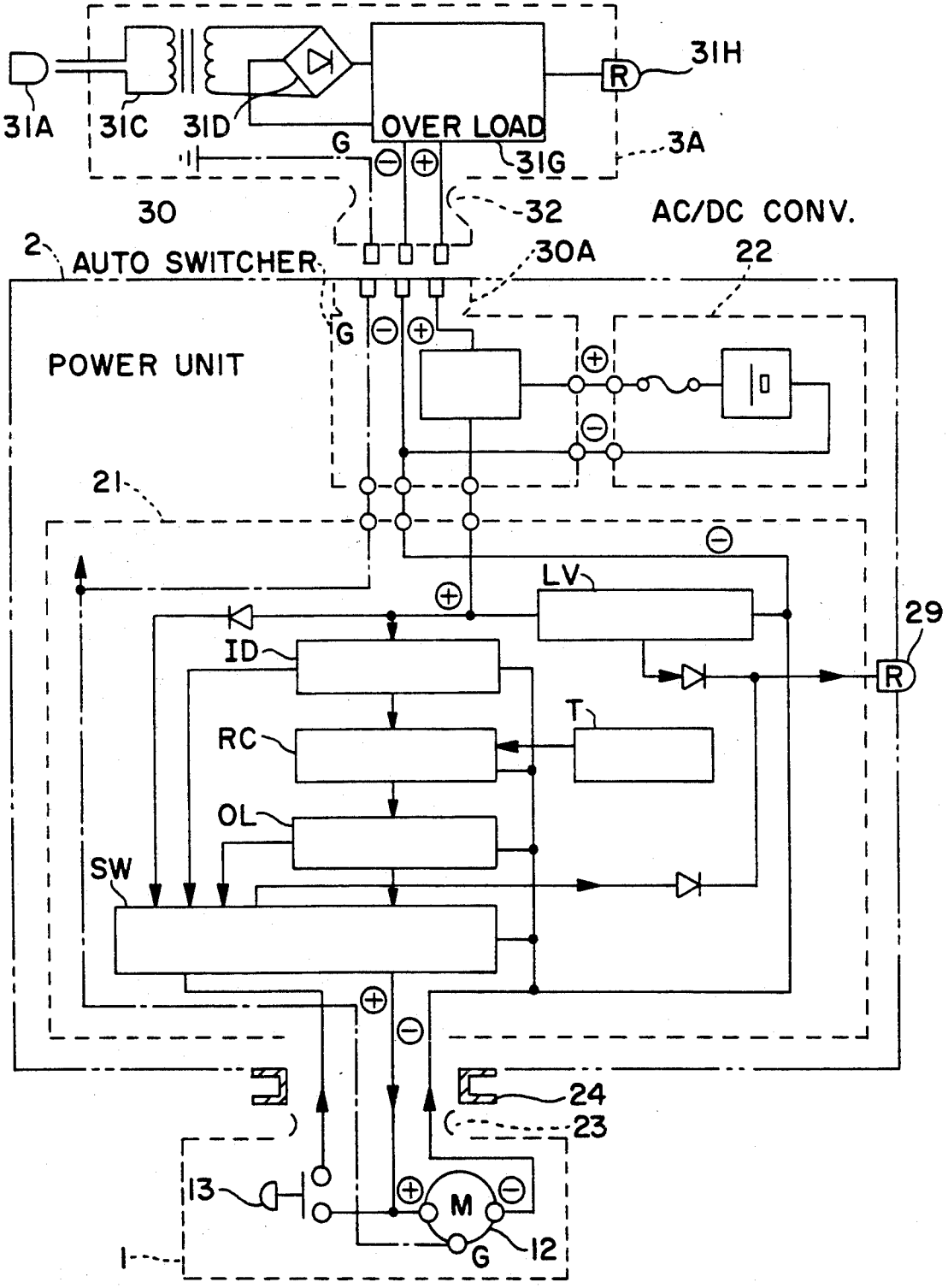
FIG. 12 is a block diagram of the electric circuits of the embodiment of FIG. 5.

FIG. 12 shows an electric circuit of this embodiment of the invention. FIG. 12 shows the connection during ordinary use in which the motor 12 of the case 1 is supplied by the driving current from the battery 22 via the controller 21 of the power source unit 2. A voltage drop detector circuit LV of the controller 21 detects the discharged state of the battery 22, and informs the user by causing the light emitting device 29 to flicker. When the user removes the casing 1 from the water, the idling preventive circuit ID shuts off the driving current of the motor 12 by a switch circuit SW in order to prevent idling of the motor 12. If the user places the casing 1 back in the water, and pushes the switch 13, the device 29 is illuminated and the motor is actuated again. The rush current prevention circuit RC restricts the level of the driving current to be supplied to the motor 12 for the initial 0.8 seconds by means of a timer T, as water does not immediately fill the pump when the casing 1 is first placed in the water. The overcurrent detecting circuit OL may be of conventional design.

Figure 13:
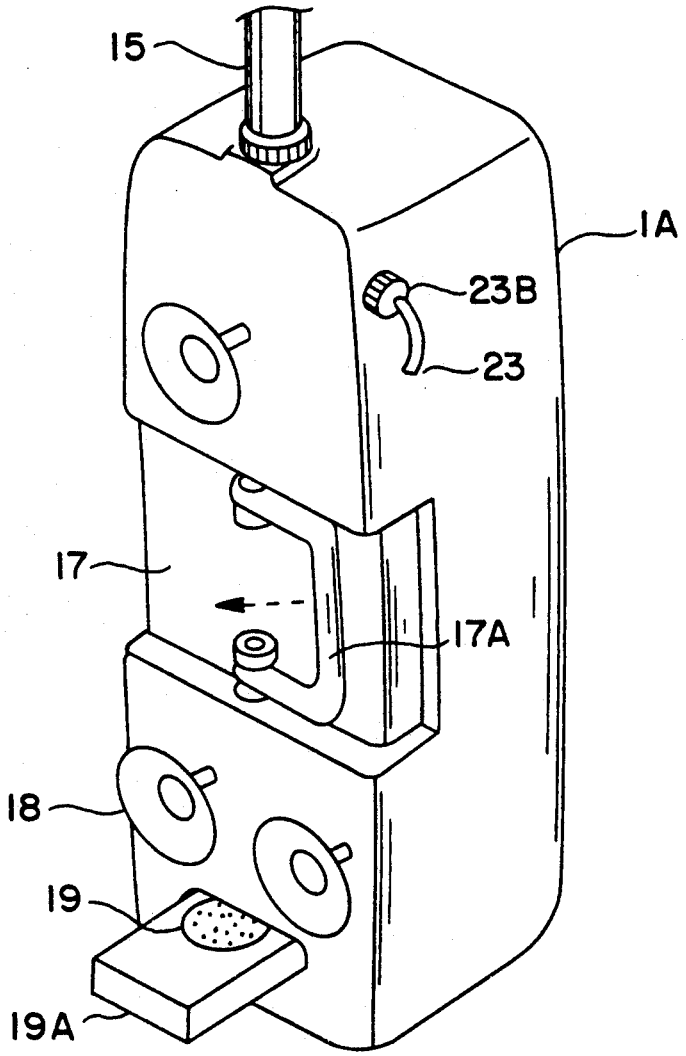
FIG. 13 is a perspective view of a casing in a further embodiment according to the invention.

FIG. 13 shows another embodiment of a casing 1A according to this invention. This embodiment is provided with a handle 17A as the grip for the casing 1A. The handle 17A is swung into the recessed portion 17 for storage. For transport, the handle 17A is pulled out of the recessed portion 17 in the direction shown by an arrow and is used to hold the casing 1A after the casing 1A is separated from the unit (not shown). The automatic power source switch is housed internally in the power source unit, but it may be placed inside the AC/DC converter.

As described in detail, the casing is light and small so that the device 4 can be easily handled within a small bathtub in a narrow bathroom. As it is fixed on the bathtub wall by suction cups, devices according to the invention provide an air bubble generating device which can be used even in small sized or Western style bathtubs.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An air bubble generating device for use in a bathtub comprising the combination of a casing having an electric pump operative to take in and pressurize water from a bathtub, an air inlet operative to take in air from a region above the water in a bathtub, and a nozzle operative to jet a mixture of the air taken in by the air inlet and water taken in and pressurized by the pump into the water in the bathtub, said casing being provided with means for gripping the casing by hand, and a plurality of suction cups provided on a rear side of the casing opposite said nozzle for attaching the casing to an inner wall surface of the bathtub and further including a power source unit for driving said electric pump separately provided from said casing, and wherein said power source unit is operative to convert power from a commercial power source to a DC current, and said power source unit is provided with an idling prevention circuit which essentially suspends output current from the power source unit when the pump is in an idle state, and a rush current reducing circuit which reduces the rush current when the electric pump is actuated.

2. The air bubble generating device as claimed in claim 1, wherein said air inlet comprises a self-supporting pipe made of rubber and projecting upwardly from said casing.

3. The air bubble generating device as claimed in claim 2, wherein said self-supporting pipe is freely detachable from the casing.

4. The air bubble generating device according to claim 1, wherein said means for gripping the casing by hand comprises a recessed portion formed in said casing.

* * * * *

UNITED STATES PATENT AND TRADEMARK OFFICE

CERTIFICATE OF CORRECTION

PATENT NO. : 5,197,153

DATED : March 30, 1993

INVENTOR(S) : Zenzaburo Hara

It is certified that error appears in the above-identified patent and that said Letters Patent is hereby corrected as shown below:

On the title page, add:

Item:[73] Assignee: --Hara Health Ind. Co., Ltd., Tokyo, Japan--

Signed and Sealed this

Twenty-third Day of November, 1993

*Attest:*

Bruce Lehman

BRUCE LEHMAN

*Attesting Officer*

*Commissioner of Patents and Trademarks*